United States Patent [19]

Hsieh

[11] Patent Number: 4,977,810

[45] Date of Patent: Dec. 18, 1990

[54] MEANS FOR REGULATING CYMBAL PEDAL TAUTNESS

[76] Inventor: Wu H. Hsieh, No. 178, Chung Shan Erh Rd., Lu Chou Hsiang, Taipei Hsien, Taiwan

[21] Appl. No.: 500,757

[22] Filed: Mar. 28, 1990

[51] Int. Cl.[5] ..... G10D 13/00

[52] U.S. Cl. ..... 84/422.3

[58] Field of Search ..... 84/422.1, 422.3

[56] References Cited

U.S. PATENT DOCUMENTS

| | | | |
|---|---|---|---|
| 2,828,660 | 4/1958 | Paulsen | 84/312 R |
| 3,530,757 | 9/1970 | Osuga | 84/422.3 |
| 4,449,440 | 5/1984 | Hoshino | 84/422.3 |
| 4,846,040 | 7/1989 | Hoshino | 84/422.3 |

*Primary Examiner*—Lawrence R. Franklin

*Attorney, Agent, or Firm*—Fitch, Even, Tabin & Flannery

[57] ABSTRACT

A means for regulating cymbal pedal tautness includes an end block to which an end of a spring is attached. The spring extends downwardly and attaches at the other end to a coupling block. To one of the coupling block is attached a lower draw bar which extends downwardly to connect with the pedal by means of which the cymbals are operated. To the other end of the coupling block is attached an upper draw bar which extends up through the end block to connect with a top cymbal. A tap of the foot on the pedal subsequently causes the top cymbal to rapidly descend crashing on the bottom cymbal to produce the appropriate musical effect. The pedal and, consequently, the top cymbal are returned to their original positions by the restorative force in the spring. A tension in the spring is regulatable by means of a screw acceptor block provided on an inner surface with screw threadings within which set screws which protrude from the end block rest.

3 Claims, 4 Drawing Sheets

MEANS FOR REGULATING CYMBAL PEDAL TAUTNESS

BACKGROUND OF THE INVENTION

This invention relates to musical cymbals, and, more particularly, to a means for maintaining the tautness in the pedal by which the cymbals are operated.

Conventionally, the tautness in the pedal is maintained by a means as shown in FIG. 5. The pedal 90 is connected by means of a pedal chain 91 to a lower draw bar 62. An upper end of the draw bar 62 connects with a coupling block 50 to which a lower end of an upper draw bar is also connected. A depression of the pedal 90 subsequently causes the upper draw bar, to an upper end of which is attached a top cymbal, to rapidly descend causing the top cymbal (not shown) to crash down on the bottom cymbal (also not shown) producing the appropriate musical effect. Therefore, when at rest, the pedal 90 is raised slightly above the ground, so that the cymbals can be operated by a tap of the foot. Conventionally, such means for holding the pedal 90 slightly above the ground, as well as maintaining a certain amount of tautness in the pedal, is provided in the form of a spring-loaded mechanism. With reference again to FIG. 5, one end of a spring 61 is connected to the coupling block 50 and the other end to a end block 71. The upper draw bar 64, disposed within the central hollow of the spring 61, extends up through the end block 71. When the pedal is depressed, the spring 61 stretches downwardly along with the coupling block 50; however, when the pedal is released, the spring 61 retracts back causing the coupling block 50, and consequently, the pedal 90, to rise.

The particular tautness in the pedal, as well as the height of the pedal above the ground is of interest to the musician who is concerned, not only with the musical integrity of the percussional sound, but also with the "feel" of the instrument. Therefore, the height of the end block 71 above the coupling block 50 is conventionally adjustable in order to regulate the tension in the spring 61. The tube 60 is, therefore, provided with two diametrically opposed slots 63 through which each end of the end block 71 extends. V-type screw threads 72 are provided on the tube 60 in the region of the slots 63. An adjusting block 70, within which both ends of the end block 71 rest, is engageable with the threads 72 such that the end block 71 is raised or lowered by twisting the adjusting block 70.

Although, the "feel" of the pedal is thereby maintained by adjustments to the tension in the spring 61, the prior art possesses four very distinct drawbacks. First, the threading 72 is left exposed to the elements and therefore is easily clogged with dust. Also a user's fingers are easily injured on the threading during adjustment of the end block 71. Furthermore, the slots 63 formed in the tube 60 in the region of the threading 62 causes discontinuities in the threading 62. The threading provided on the inner surface of the adjusting block 70, therefore, does not properly engage with the threading 62 and can grate against the threading 62 causing wear. Moreover, because the adjusting block 70 is also subject to the rather substantial forces applied to the end block 71 due to depression of the pedal, additional stress is placed on the threading 62 causing additional erosion.

It is the purpose of this present invention, therefore, to mitigate and/or obviate the above-mentioned drawbacks in the manner set forth in the detailed description of the preferred embodiment.

SUMMARY OF THE INVENTION

It is accordingly a primary objective of the present invention to provide a means for regulating cymbal pedal tautness where all screw threading is protected and not left exposed to the elements.

It is a further objective of the present invention to provide a means for regulating a cymbal pedal tautness which is convenient to use.

It is a further objective of the present invention to provide a means for regulating a cymbal pedal tautness which is of rugged design.

It is a further objective of the present invention to provide a means for regulating a cymbal pedal tautness which is of sturdy construction.

It is a further objective of the present invention to provide a means for regulating a cymbal pedal tautness which protects the musician from injury.

A means for regulating cymbal pedal tautness of the present invention obviates drawbacks related to the exposed screw threading on the outside of the tube by replacing the adjusting block with a screw acceptor. The screw acceptor is provided on an inner surface thereof with square-type screw threading. Furthermore, the end block is designed to rest within the screw acceptor so that a twist of the screw acceptor causes the end block to either rise or fall, allowing the respective tightening or loosening of the spring and consequently the pedal.

Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
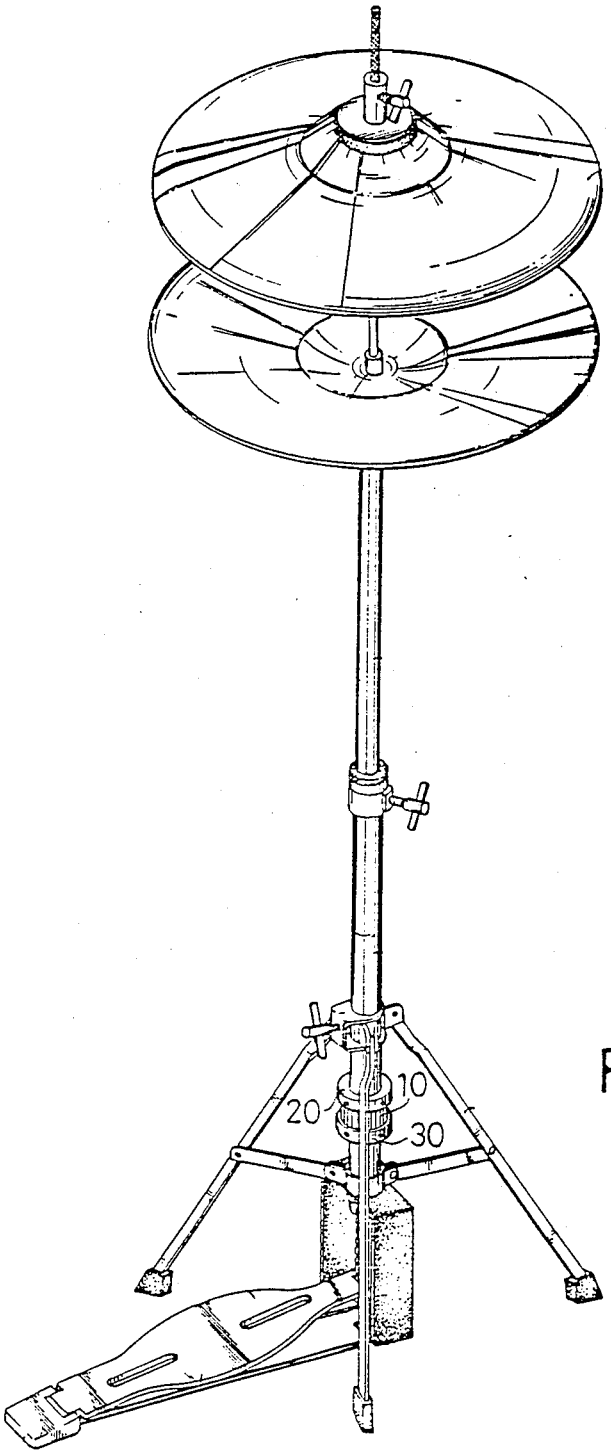
FIG. 1 is a perspective view of musical cymbals fitted with the means for maintaining tautness in the pedal in accordance with the present invention.

FIG. 1 shows musical cymbals provided with means, in accordance with the present invention, for maintaining tautness in the pedal comprising a screw acceptor 10 sandwiched between an upper guide block 20 and a lower guide block 30. It will be noted that no screw threading is left exposed.

Figure 2:
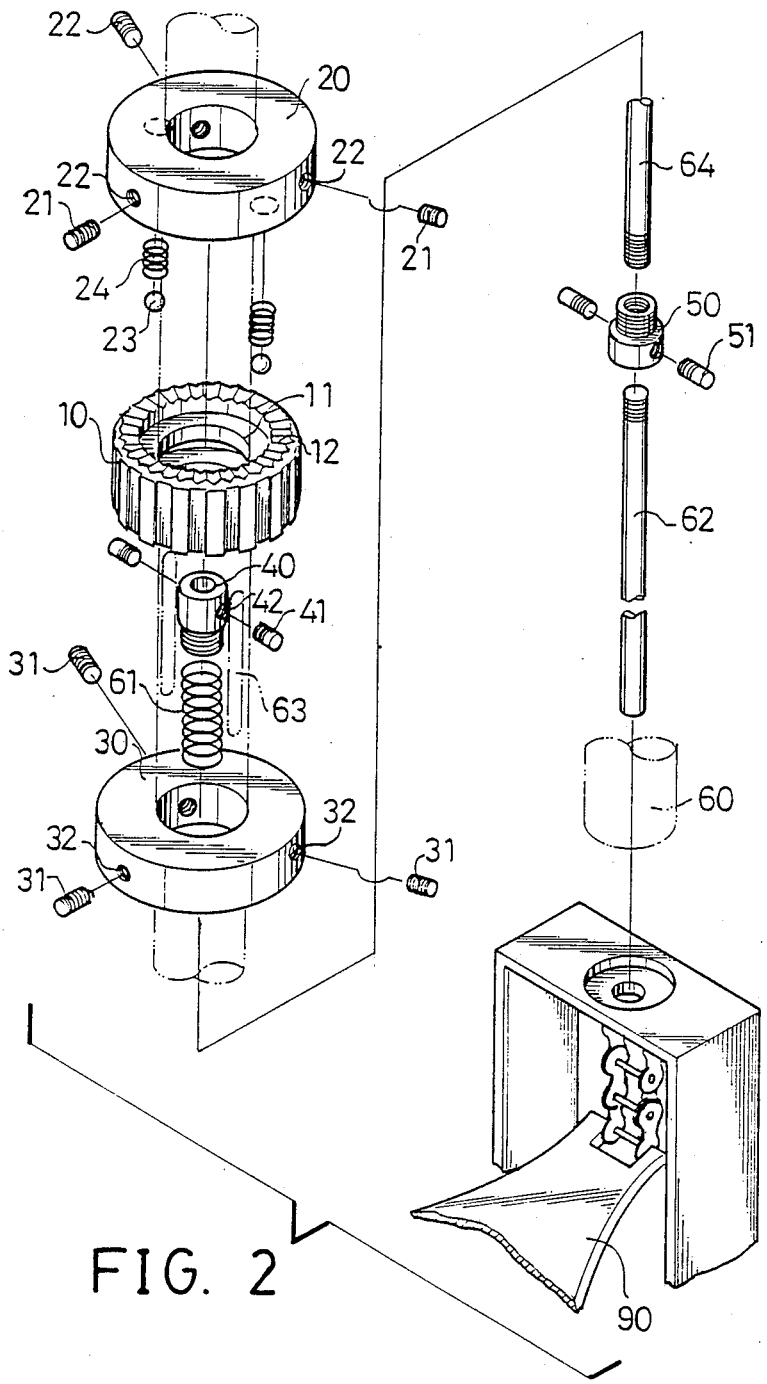
FIG. 2 is an exploded view of means for maintaining tautness in a pedal for musical cymbals in accordance with the present invention.

FIG. 2 shows the cymbal pedal 90 which is connected by means of the pedal chain 91 to a lower draw bar 62. The pedal chain 91 is connected to the draw bar 62 by ordinary and well-known means, not comprising a part of the invention, and therefore not specifically drawn in. The lower draw bar 62 at an upper end thereof screwably connects with a coupling block 50. A pair of set screws 51 further secure the connection. An upper draw bar 64 screwably connects at a lower end thereof to the coupling block 50. Therefore, a depression of the pedal 90 causes the lower draw bar 62, and consequently, the upper draw bar 64 to descend. To an upper end of the upper draw bar 64 is attached one of a pair of cymbals—the top cymbal. A depression of the pedal 90 therefore causes the top cymbal to crash down against the bottom cymbal producing the appropriate musical effect.

When at rest, the pedal 90 is raised above the ground so that the cymbals are operated by a tap of the foot (as shown in FIG. 1). But, when released, the pedal 90 should return to an original position thereof, the upper draw bar 64 should rise back to its own original position and the top cymbal to separate from the bottom cymbal. Therefore, a spring 61 is attached at one end thereof to the coupling block 50, and at another end thereof to a end block 40 to provide a restorative force. The end block 40 is securably fixed within the hollow tube 60 so that a depression of the pedal 90 causes the spring 61 to extend downwardly, while a release of the pedal 90 allows the spring 61 to retract, causing the coupling block 50 to rise, which, in turn, causes both the pedal 90 and the upper draw bar 64 to be raised.

The tension in the spring 61, and thus the "feel" of the pedal, is however, regulatable. The portion of the tube 60 within which the end block 40 is disposed is formed with two diametrically opposed slots 63. Set screws 41, which screw into threaded holes 42 disposed on diametrically opposed sides of the end block 40, protrude through the slots 63. The set screws 41 are received within the screw acceptor 10. The screw acceptor 10 is formed on an inner perimeter thereof with rectangular screw threading 11 within which the set screws 41 fit holding the end block 40 secure within the tube 60.

An outer perimeter of the screw acceptor 10 is formed with a grooved pattern 13 for the easy grip of the musician. To adjust the tautness in the pedal, the musician grips the screw acceptor 10 between his thumb and forefinger. A counterclockwise twist causes the end block 40 within to rise, forcing the spring 61 to extend thereby tightening the pedal 90. A clockwise twist likewise loosens the pedal.

The threading 11, by means of which the end block 40 is raisable, is disposed within the screw acceptor 10, the threading 11 is protected from the elements and particularly from clogging with dust. Moreover, the musician's fingers are thereby protected from injury.

With reference again to FIG. 2, the lower guideblock 30 is symmetrically provided with three threaded through holes 32 by means of which three set screws 31 fix the lower guide block 30 to the tube 60. The upper guide block 20 is similarly provided with three threaded through holes 22 by means of which three set screws 21 fix the upper guide block to the tube 60 above the screw acceptor 10. An upper surface of the screw acceptor is provided with V-shaped grooves 12 within which two ball bearings 23 sit. Each ball bearings 23 fits to a hole 25 in the upper guide block 20 which has been provided with a spring 24.

Figure 3:
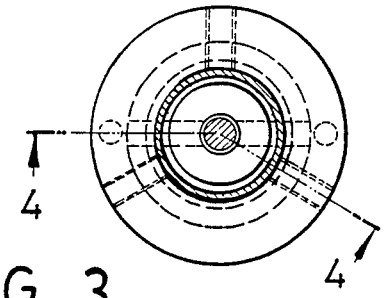
FIG. 3 is a cross-sectional top view of FIG. 2.
Figure 4:
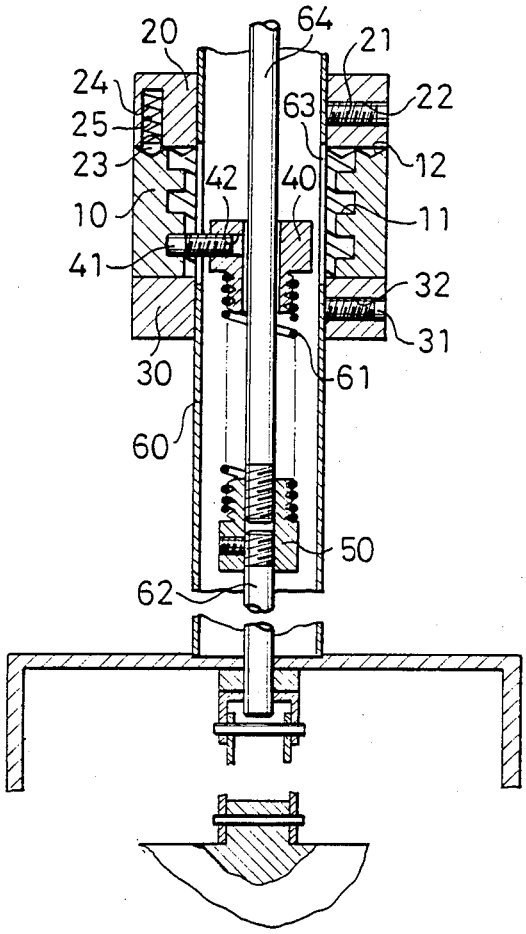
FIG. 4 is a cross-sectional side view of FIG. 2.
Figure 5:
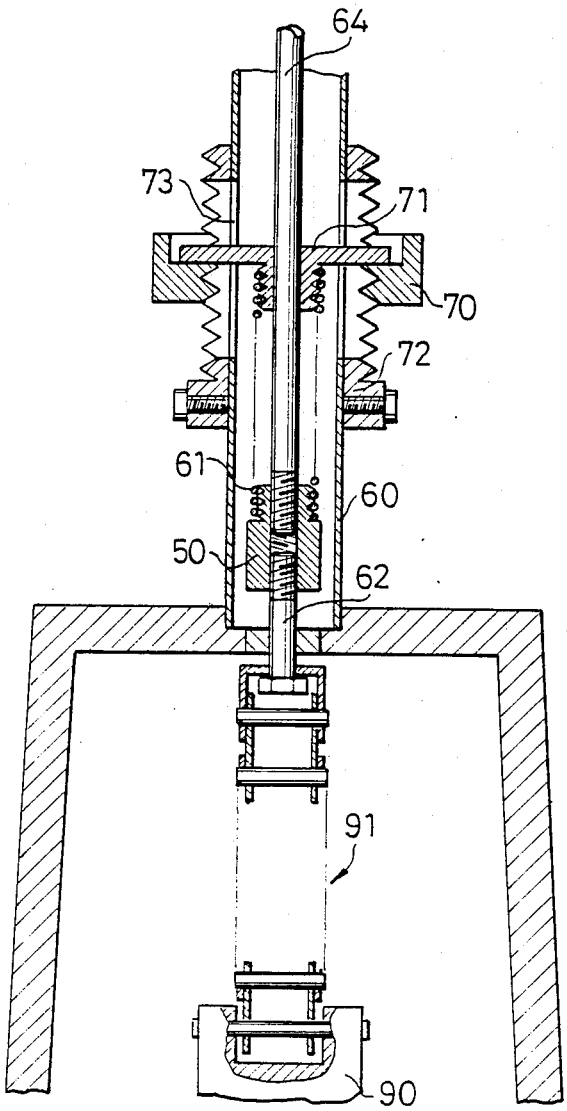
FIG. 5 is a prior art.

FIG. 3 shows the position of the ball bearings with respect to the set screws 21, 31. FIG. 4, then, shows the assembled.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A means for regulating cymbal pedal tautness comprising a pedal connected by a pedal chain to a lower draw bar, said lower draw bar connected at an upper end thereof to a coupling block, a spring being connected at one end to said coupling block and at another end to an end block, an upper draw bar being connected at a lower end thereof to said coupling block, said upper draw bar extending up through said end block and connecting at an upper end thereof to a top cymbal, a depression of said pedal causing the top cymbal to rapidly descend crashing down on a lower cymbal to produce a percussional effect, the improvement wherein;

a tube within which said upper and lower draw bar are disposed is formed with two diametrically opposed slots in the region of said end block, two set screws which fix into said end block each protruding through a said slot, each said set screw resting within a screw acceptor formed on an inner surface thereof with screw threading, a twist of said screw acceptor causing said spring to either loosen or tighten thus regulating the pedal tautness, said screw acceptor further being formed on an upper surface thereof with V-shaped teeth, a pair of ball bearings being disposed within said V-shaped teeth, said ball bearing each fitting in a respective spring loaded recess formed in one of an upper fixed ring disposed above said screw acceptor or a lower fixed ring being disposed below said screw acceptor.

2. A means for regulating cymbal pedal tautness according to claim 1, wherein said screw threading is provided in the form of a square thread.

3. A means for regulating cymbal pedal tautness according to claim 1, wherein said screw threading is providing in the form of a trapezoidal thread.

* * * * *

UNITED STATES PATENT AND TRADEMARK OFFICE

CERTIFICATE OF CORRECTION

PATENT NO. : 4,977,810

DATED : December 18, 1990

INVENTOR(S) : Wu Hung Hsieh

It is certified that error appears in the above-identified patent and that said Letters Patent is hereby corrected as shown below:

Column 1, line 51, after "Although", delete --,-- (comma).

Column 3, line 12, change "to" to --should--.

Column 3, line 14, change "a", first occurrence, to --an--.

Column 3, line 23, after "is", insert --,-- (comma).

Column 4, line 2, change "bearings", second occurrence, to --bearing--.

Column 4, line 42, change "bearing" to --bearings--.

Column 4, line 45, delete "being".

Column 4, line 52, change "providing" to --provided--.

Signed and Sealed this

Fourteenth Day of July, 1992

*Attest:*

DOUGLAS B. COMER

*Attesting Officer*

*Acting Commissioner of Patents and Trademarks*